US005669778A

United States Patent [19]

Krämer et al.

[11] Patent Number: 5,669,778

[45] Date of Patent: Sep. 23, 1997

[54] IDC BRANCH CONNECTOR FOR LARGE RANGE OF WIRE SIZES

[75] Inventors: Rudolf Krämer, Lautertal; Harald Michael Lutsch, Dietzenbach, both of Germany

[73] Assignee: The Whitaker Corporation, Wilmington, Del.

[21] Appl. No.: 563,248

[22] Filed: Nov. 27, 1995

[30] Foreign Application Priority Data

Dec. 13, 1994 [GB] United Kingdom ..... 9425107

[51] Int. Cl.[6] ..... H01R 4/24

[52] U.S. Cl. ..... 439/398; 439/399

[58] Field of Search ..... 439/395, 877, 439/880, 399, 598, 400, 401–407

[56] References Cited

U.S. PATENT DOCUMENTS

| | | | |
|---|---|---|---|
| 4,145,103 | 3/1979 | Knowles | 229/99 R |
| 4,160,573 | 7/1979 | Weisenburger | 339/99 R |
| 4,256,360 | 3/1981 | Debaight . | |
| 4,261,629 | 4/1981 | Reynolds et al. | 339/17 C |
| 4,412,374 | 11/1983 | Forberg et al. | 29/566.4 |
| 4,437,721 | 3/1984 | Kollmann et al. | 339/97 P |
| 4,472,596 | 9/1984 | Brown et al. | 174/84 C |
| 4,539,748 | 9/1985 | Brown et al. | 29/874 |
| 4,660,917 | 4/1987 | DeRoss | 439/404 |
| 4,834,670 | 5/1989 | Rodondi et al. | 439/389 |
| 4,964,811 | 10/1990 | Hayes, Sr. et al. | 439/398 |
| 4,971,572 | 11/1990 | Hopper | 439/407 |
| 5,025,350 | 6/1991 | Tienken | 362/61 |
| 5,078,617 | 1/1992 | Gutierrez et al. | 439/422 |

FOREIGN PATENT DOCUMENTS

| | | | |
|---|---|---|---|
| 1 524 901 | 9/1978 | United Kingdom | H01R 13/38 |

*Primary Examiner*—Gary F. Paumen
*Assistant Examiner*—Christopher Goins

[57] ABSTRACT

An IDC branch connector comprises an IDC connection section positioned on a central carrier strip. Strain relief sections extend from either side of the carrier strip such that a wire terminated to the IDC section is securely held on either side. The IDC section comprises first IDC slots positioned between second larger IDC slots such that a large range of wire sizes can be terminated thereto. The branch connector is overmoulded by an insulative housing, whereby the carrier strip can be maintained between a plurality of connector modules depending on the number of wires to be interconnected.

6 Claims, 5 Drawing Sheets

IDC BRANCH CONNECTOR FOR LARGE RANGE OF WIRE SIZES

BACKGROUND OF THE INVENTION

1. Field of the Invention

This invention relates to an insulation displacing contact (IDC) branch connector for distributing electrical current between conducting wires, such wires possibly having a range of different sizes.

2. Description of the Prior Art

It is typical to find the use of branch connectors in automobiles for distributing electrical current. Such branch connectors are used in an automobile to distribute earth or positive pole to a plurality of conductors in the appropriate positions in the vehicle. There are many different wire sizes depending on the electrical current needs, that need to be connected to the branch connector. Furthermore, there are different numbers of wires that need to be connected to the various branch connectors. It is often appropriate to connect the branch connector to the various wires at any position therealong, i.e. to the end of the wire or in an intermediate section of the wire, such that the wire should transverse the connector without electrical discontinuity. A further requirement for such connectors is that they are reliable and cost-effective not only to manufacture, but also to handle and assemble to the automobile and wires.

SUMMARY OF THE INVENTION

It is therefore desirable to provide a cost-effective and reliable branch connector that can be connected to a large range of wire sizes and different numbers of wires at any position along such wires.

It is an object of this invention to provide a robust and reliable IDC branch connector that is cost-effective to manufacture and assemble.

It is a further object of this invention to provide an IDC branch connector for connection to a large range of wire sizes at end or intermediate portions along the wires whilst maintaining electrical continuity and mechanical strength in the cable.

The objects of this invention have been achieved by providing an IDC branch connector comprising a plurality of terminals electrically interconnected and inmoulded to an insulative housing, the terminals comprising a base portion, a pair of strain relief portions extending from the base portion in opposing directions, and an IDC section attached to the base portion between the pair of strain relief sections, the IDC section having a first slot adapted to connect to small wire sizes and a second slot adapted to connect to larger wire sizes, the first and second slots aligned with each other and positioned between and aligned with the strain relief sections for connection to a longitudinal portion of wire securely attachable to the strain relief portions. Improvements may comprise an IDC section having a pair of central first IDC slots flanked by a pair of outer second IDC slots to form a substantially W-shaped profile. Outer opposed ends of the strain relief sections may have tabs projecting therefrom for overmoulding by the insulative housing in order to provide a secure anchor for forces pulling up from the base section. The base section could be formed by the carrier strip that is used to transport and interconnect the strain relief sections during stamping and forming thereof, whereby the insulative housing can be overmoulded to a fixed plurality of terminals (e.g. 3) whilst the carrier strip extending between connectors is maintained for handling and transport. If a greater plurality of wires need to be interconnected than the connector has terminals, then a plurality of the connectors can be left interconnected with the carrier strip.

DETAILED DESCRIPTION OF THE PREFERRED EMBODIMENT

Figure 1:
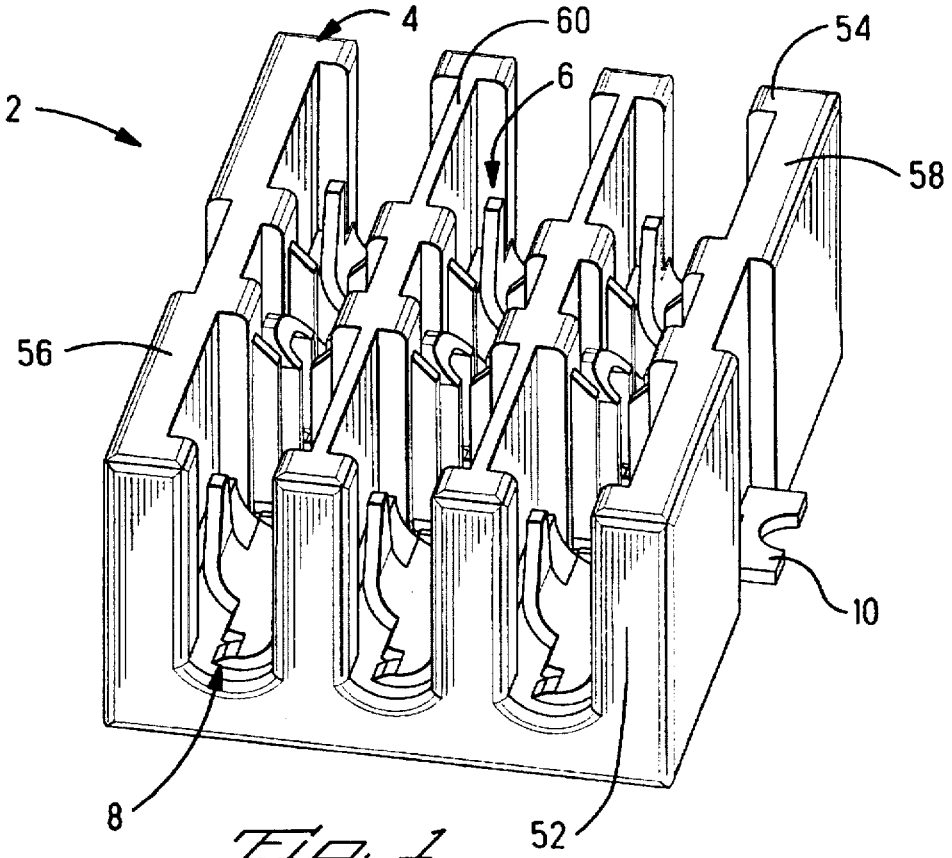
FIG. 1 is an isometric view of an IDC branch connector module.
Figure 2:
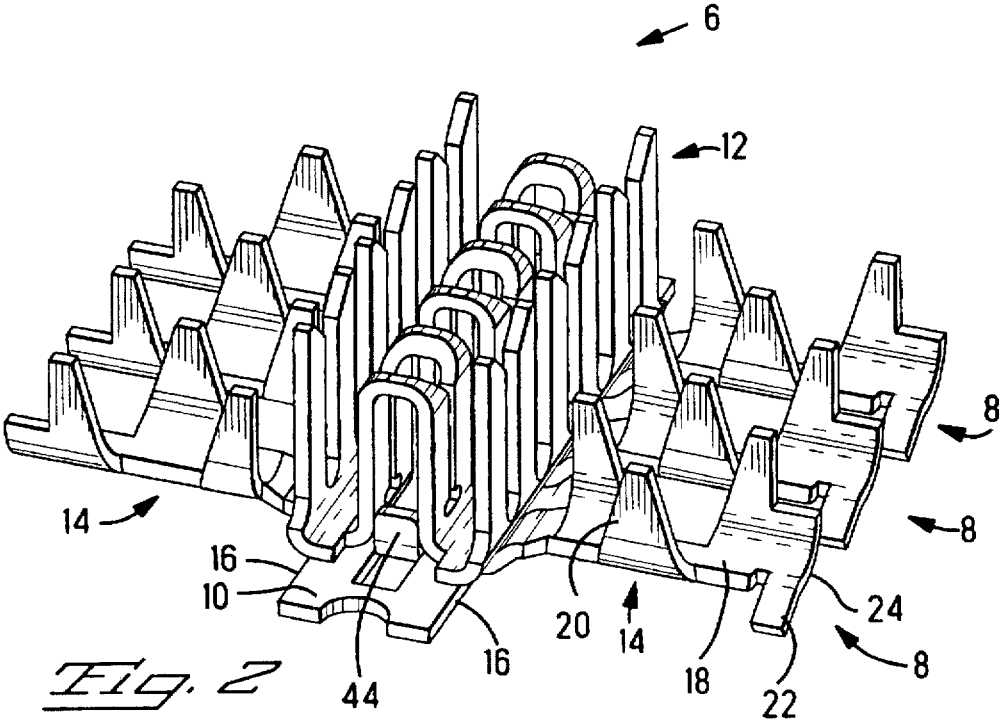
FIG. 2 is an isometric view of the terminals without housing of the module of FIG. 1.
Figure 3:
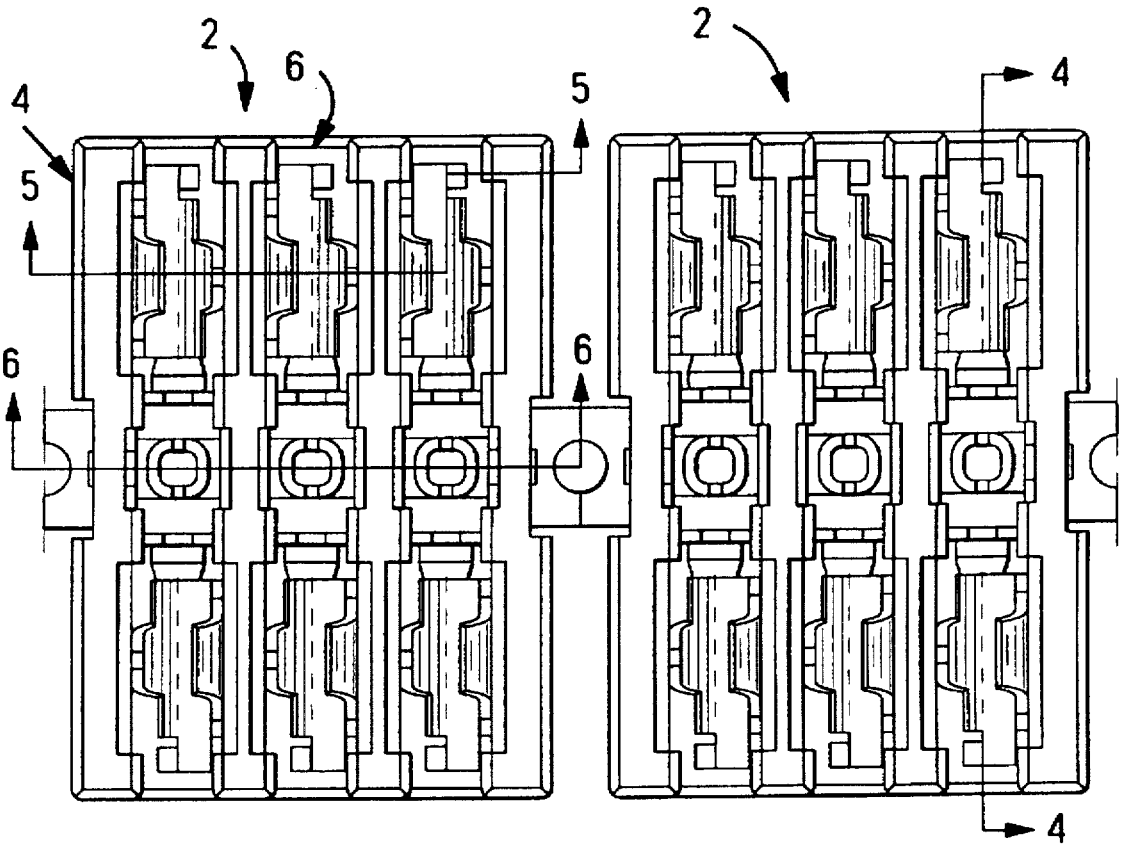
FIG. 3 is a top view of two modules interconnected.
Figure 7:
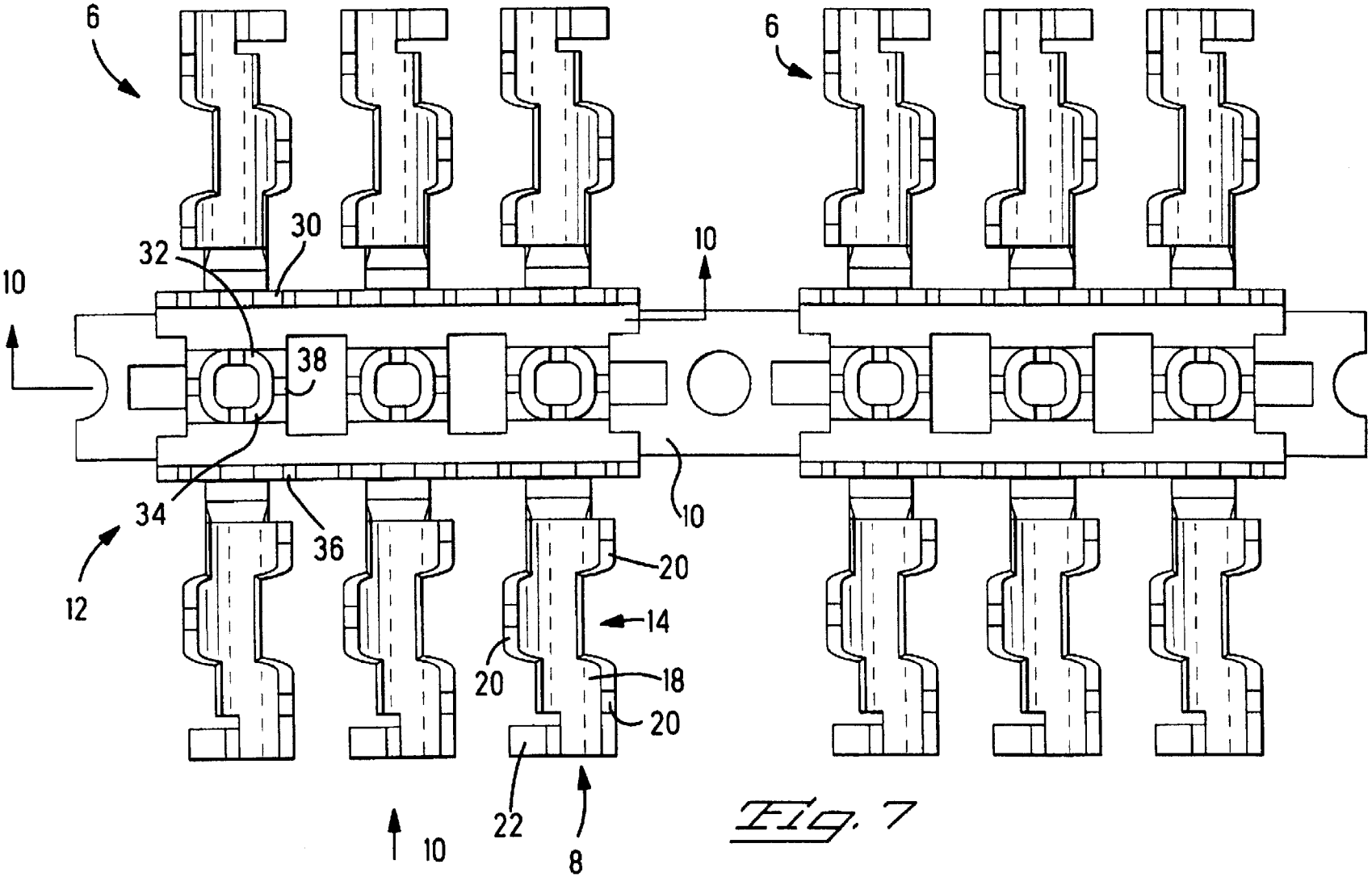
FIG. 7 is a top view of the terminals of two modules.

Referring to FIGS. 1 and 2, a branch connector module 2 is shown comprising an insulative housing 4 that is overmoulded over a plurality of terminals 6 stamped and formed from sheet metal. The plurality of terminals 6 comprises individual terminal sections 8 arranged in a juxtaposed manner. The plurality of terminals 6 comprises a central base portion 10, a W-shaped IDC contact section 12 upstanding therefrom, and strain relief sections 14 extending in opposed directions from side edges 16 of the base portion 10. The base portion 10 is part of a carrier strip that interconnects the strain relief portions 14 between each other during manufacturing and transport, and also interconnects the plurality of connector modules 2 during manufacturing. The carrier strip can be separated between adjacent connector modules to separate these modules, or can be left integral between a plurality of connector modules (as shown in FIGS. 3 and 7) to provide a branch connector module for interconnecting a greater number of wires. A large number of wires can thus be interconnected in a cost-effective and simple manner by selecting the number of connector modules 2 to remain interconnected on a portion of the carrier strip. The insulative housings can be overmoulded to the plurality of terminals 6 whilst still connected to the carrier strip thus enabling easy handling of the connector modules, and spooling onto a transport reel for transportation to the wire connection site (e.g. the automobile manufacturing site, or harness making site). For subsequent connection to the corresponding conducting wires, separation from the carrier strip then takes place. The latter thus allows cost-effective manufacturing, transport and assembly to conducting wires.

The strain relief sections 14 extend substantially transversely to the direction of the carrier strip and are provided with an arcuate base portion 18 and upstanding therefrom crimping arms 20 that are crimpable over a wire positioned on the base portion 18 for securely holding the wire thereto. The pair of strain relief sections 14 extending from opposing sides 16 of the base portion 10 ensures that a wire terminated to the IDC contact section 12 is securely held to the connector module from forces pulling on and along the wire in opposed directions, as well as forces pulling either side of the wire with respect to the IDC section 12 in an upwards direction away from the base portion 10. The disposition of strain relief sections 14 on either side of the IDC section 12 is particularly relevant when connecting to wires at an intermediate portion as the IDC connection section structurally weakens the wire which therefore needs to be securely held to the connector on either side of the connection section.

The strain relief sections 14 comprise downwardly extending tabs 22 proximate outer ends 24 that are distant from the base portion 10. The tabs 22 are overmoulded by the housing 4 as shown in FIG. 5, and serve as an anchor to prevent upward deformation of the strain relief section caused by upward pulling force on a wire connected to the strain relief section (the upward direction is shown by the arrow U in FIG. 5).

Figure 4:
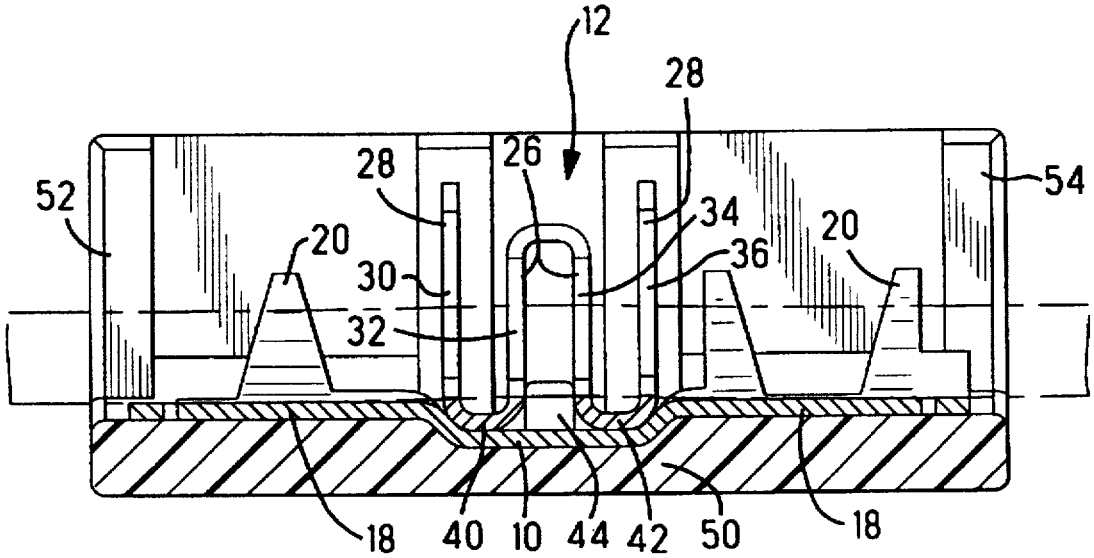
FIG. 4 is a cross-sectional view through lines 4—4 of FIG. 3.
Figure 8:
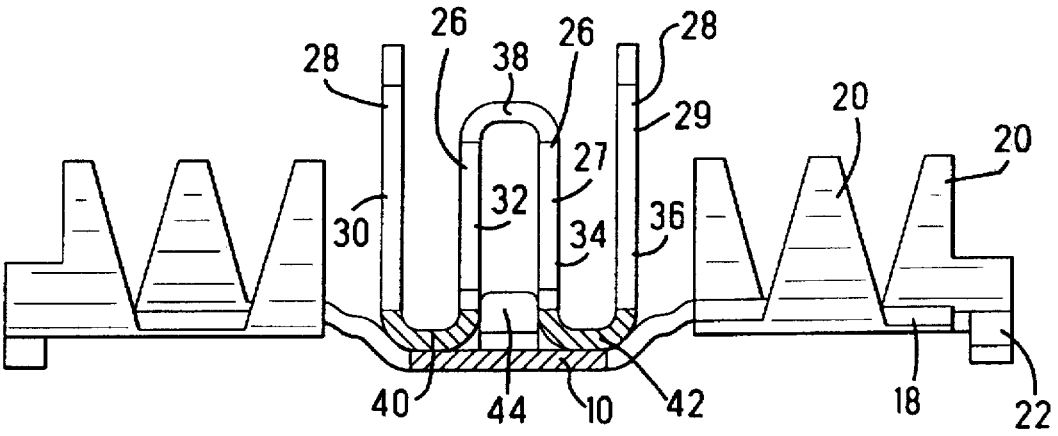
FIG. 8 is a cross-sectional view through lines 8—8 of FIG. 9.
Figure 9:
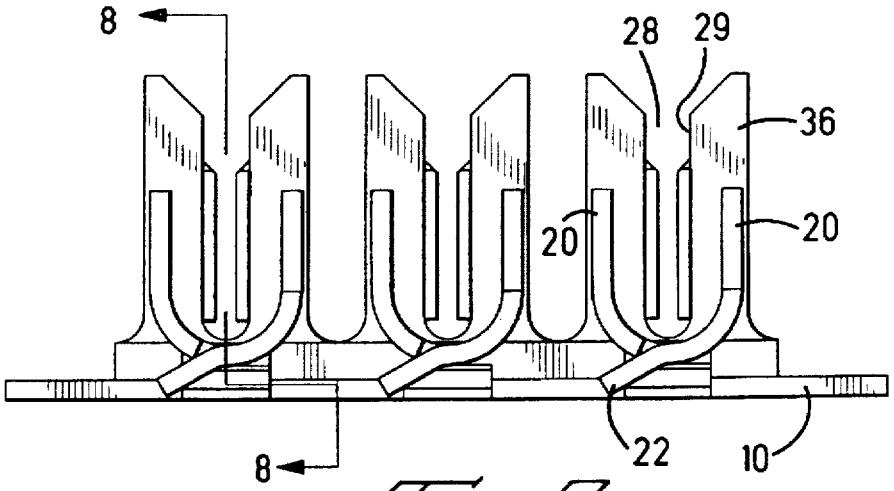
FIG. 9 is a view in the direction of arrow 10 of FIG. 7.
Figure 10:
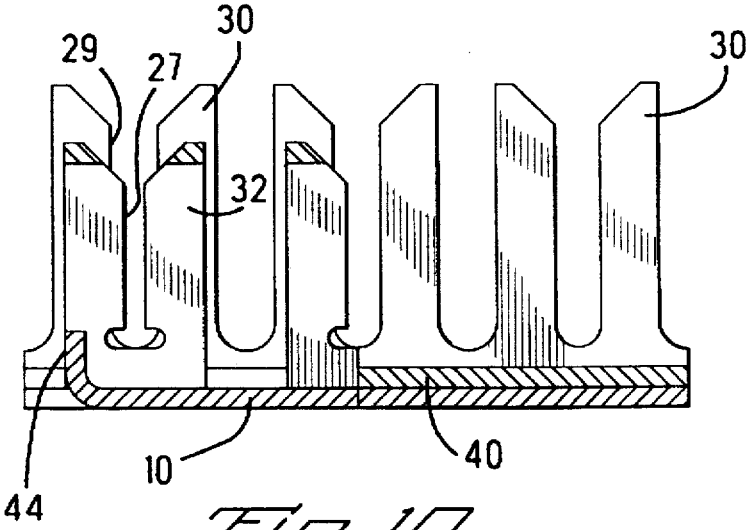
FIG. 10 is a cross-sectional view through lines 10—10 of FIG. 7.

Referring to FIGS. 4, 8 and 1, the IDC section 12 has a W-shaped profile when looking in the direction of the carrier strip 10 and is stamped and formed from sheet metal and comprises a pair of first IDC contact slots 26 positioned between a pair of second IDC slots 28. The IDC slots 26 and 28 are stamped from an integral sheet metal strip that is bent into a W-shape to form four upstanding wall portions 30, 32, 34, 36 that are parallel to each other, and substantially equally. spaced from each other, the inner wall portions 32, 34 joined at an upper end by an upper bridging portion 38, and the inner and outer wall portions 30, 32, 34, 36 joined together by lower bridging portions 40, 42 respectively. The lower bridging portions 40, 42 interconnect the wall portions 38, 32, 34, 36 of one terminal section 8 to that of other terminal sections 8 of the connector module, such that the connector module contact section 12 is an integral part. The lower bridging portions 40, 42 of the connection section 12 are mounted against the base portion 10 and can be securely attached thereto either by welding (e.g. laser welding) or by clinching of mechanical tabs therebetween (not shown).

The inner IDC slots 26 have a smaller width than the outer slots 28 for electrical connection to different wire sizes. If a small wire size range is terminated to the terminal section 8 as indicated by the dotted line in FIG. 4, edges 27 of the inner slot 26 cut through the outer insulation of the conducting wire and electrically contact the inner conducting strands. If a large wire size range is connected to the terminal section 8, then the edges 29 of the IDC slots 28 cut through the outer insulation of the larger wire and make electrical contact with the inner conducting strands. The inner IDC slot 26 will be widened by the introduction of the large wire, such expansion being unhindered by allowing some play between the IDC plate sections and the housing walls 60. The inner IDC edges 27 of the inner slot 26 will cut not only through the insulation but also partially cut through the inner conducting strands of the larger wire due to the relatively small size of the slots. This however does not matter as the outer IDC slots 28 are adapted for this larger wire and make the optimal electrical contact therewith. Due to the cutting of the outer insulation, and in the case of large wires the conducting wires by the inner IDC contact edges 27, it is advantageous to provide the opposed strain relief sections 14 extending from either edge 16 of the base section 10 such that forces on either end of the wire are securely countered by the strain relief means. The latter is especially applicable for interconnection of two wires in an intermediate position therealong whilst ensuring mechanical and electrical integrity. Still referring to FIG. 8, upstanding tabs 44 can be stamped up from the base portion 10 for insertion between the inner wall portions 32, 34 of the IDC connection section 12 for central positioning thereof during the assembly procedure, as well as providing a retention means against longitudinal pulling forces on a conducting wire terminated thereto.

Figure 5:
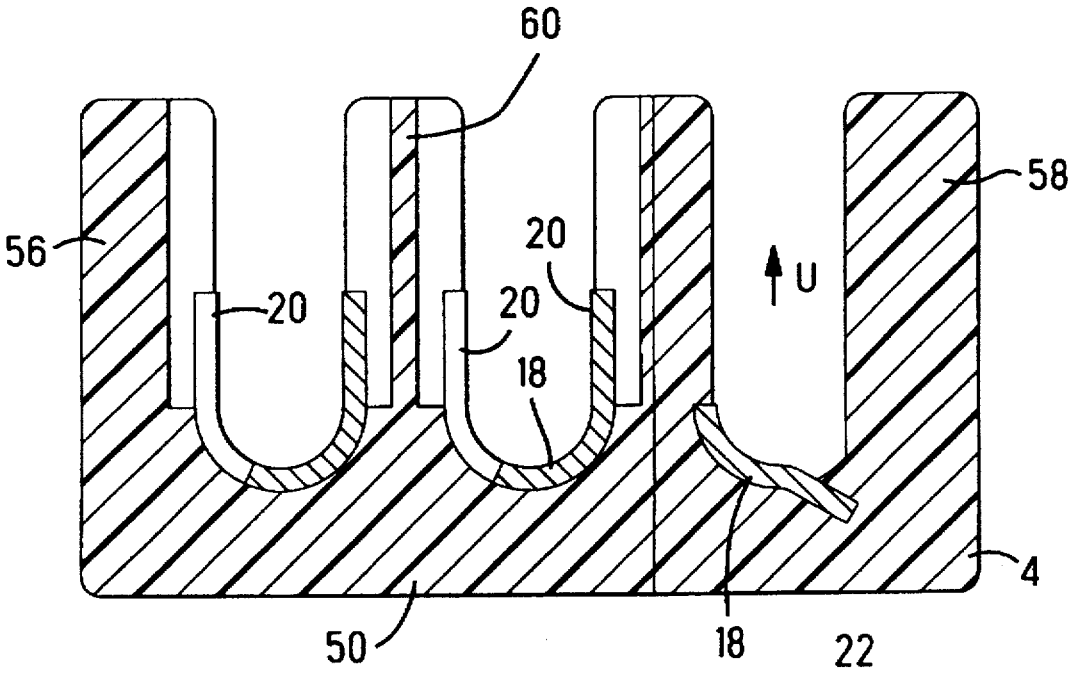
FIG. 5 is a cross-sectional view through lines 5—5 of FIG. 3.
Figure 6:
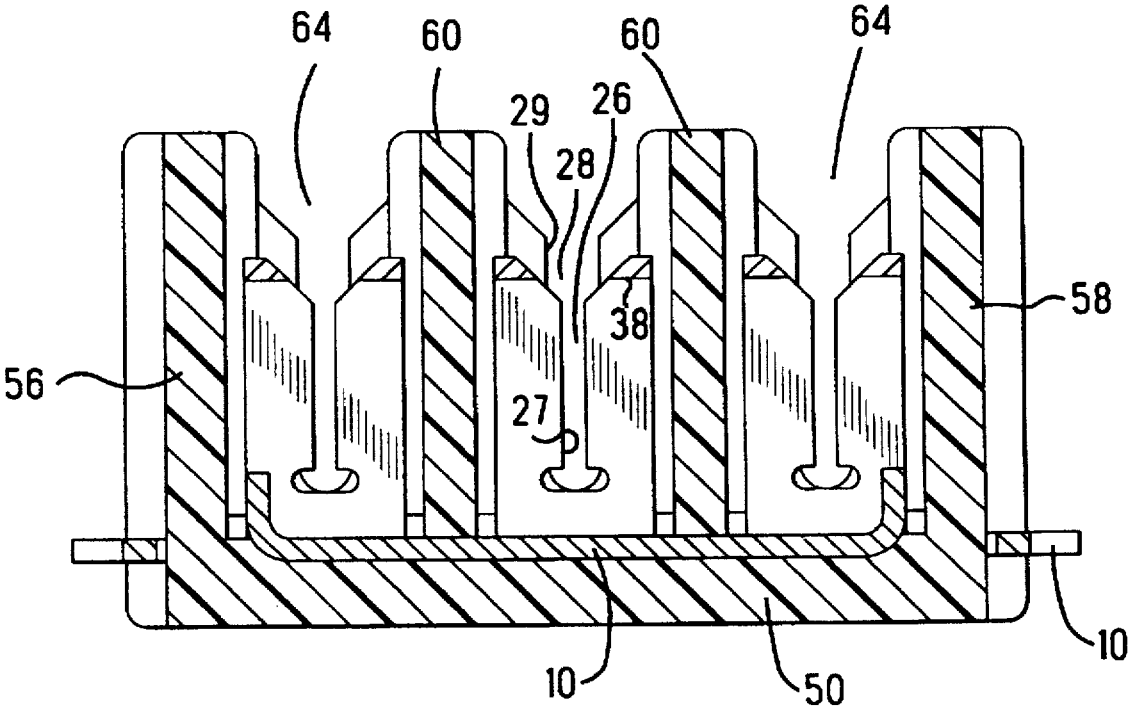
FIG. 6 is a cross-sectional view through lines 6—6 of FIG. 3.

Referring to FIGS. 1, 5 and 6, the housing 4 is shown comprising a base wall 50, end walls 52, 54 and outer side walls 56, 58 extending therebetween. There are also separation walls 60 extending between the end walls 52, 54 that separate the terminal sections from each other. The side, separating and end walls 56, 60, 52, 54 form cavities 64, within which the individual terminal sections 8 are arranged, and also provide a means not only for supporting the terminal sections but also guiding the wire into the IDC slots 26, 28 of the terminal section during termination. The intermediate separating walls 60 overmoulded over the IDC contact section lower bridging portions 40, 42 and overmoulded over the base portion 10 provide a means for securely fastening the plurality of terminals 6 to the housing in a robust manner. As shown in FIGS. 1 and 6, the base portion 10 extends beyond the side walls 58, 56 either for interconnection to adjacent connector modules, or for separation therefrom by severing the carrier strip.

Advantageously therefore, the branch connector can accept a large range of wire sizes whilst providing reliable and robust mechanical and electrical connection thereto in a cost-effective and compact manner.

We claim:

1. An electrical branch connector module for electrically interconnecting a plurality of conducting wires, comprising a plurality of terminal sections each having a base portion, insulation displacing contact (IDC) sections and strain relief sections for securely attaching conducting wires to the connector module, the terminal sections arranged in a juxtaposed manner and electrically interconnected by the base portion, each the IDC section comprises a pair of first IDC slots, the first slots adapted to connect electrically to small wire sizes, and a pair of the second IDC slots, the second slots adapted to connect electrically to larger sizes, and wherein each terminal section has a pair of strain relief sections, each strain relief section extending from opposed sides of the base portion, where the IDC sections are positioned between the pair of strain relief sections such that conducting wires connected thereto are securely held on opposing sides of the IDC sections.

2. The branch connector module of claim 1 wherein the pair of first IDC slots are positioned between the second IDC slots.

3. The branch connector of claim 2 wherein the IDC section is folded in a W profile thereby forming four planes from which the first and second IDC slots are formed.

4. The branch connector module of claim 1 wherein the module comprises an insulative housing overmoulded to the terminal sections and provided with separating walls to form cavities for receiving and guiding the conducting wires therein for connection to the terminal sections.

5. The branch connector of claim 4 wherein the strain relief sections comprise tabs extending therefrom and overmoulded by the housing to anchor the strain relief section to the housing.

6. A plurality of identical branch connector modules according to any preceding claim wherein the strain relief sections are interconnected to the base portions which are part of a carrier strip used to transport the strain relief section during the manufacturing process, the plurality of branch connector modules being held and electrically connected together by the carrier strip cut at the desired locations.

* * * * *